United States Patent [19]

Daswick

[11] 4,154,854

[45] May 15, 1979

[54] WRAPPED MEAT PATTY HAVING THINNED CENTRAL PORTION

[76] Inventor: Alexander C. Daswick, 647 Orange Grove, South Pasadena, Calif. 91030

[21] Appl. No.: 870,294

[22] Filed: Jan. 18, 1978

Related U.S. Application Data

[60] Division of Ser. No. 654,712, Feb. 3, 1976, which is a continuation-in-part of Ser. No. 209,738, Dec. 20, 1971, abandoned.

[51] Int. Cl.[2] ..... B65B 25/22

[52] U.S. Cl. ..... 426/113; 426/129; 426/144

[58] Field of Search ..... 426/92, 113, 118, 114, 426/107, 129, 244, 246, 646, 513, 514, 517, 523, 234, 144; D1/26, 99; 229/3.5 MF

[56] References Cited

U.S. PATENT DOCUMENTS

| | | | |
|---|---|---|---|
| D. 116,174 | 8/1939 | Trabold | D1/26 |
| D. 149,511 | 5/1948 | Mitrel | D1/26 |
| D. 226,595 | 4/1973 | Cavnes | D1/26 |
| 2,545,243 | 3/1951 | Runsey | 229/DIG. 14 |
| 2,633,284 | 3/1953 | Moffett et al. | 426/118 X |
| 2,670,296 | 2/1954 | Tansley | 426/513 |
| 2,686,129 | 8/1954 | Seiferth | 426/113 X |
| 2,838,404 | 6/1958 | Cohen | 426/129 X |
| 2,915,397 | 12/1959 | Telkes | 426/523 |
| 3,220,856 | 11/1965 | Vischer, Jr. | 426/113 |
| 3,863,020 | 1/1975 | Robinson | 426/646 |
| 3,978,238 | 8/1976 | Frey et al. | 426/523 |

*Primary Examiner*—Steven L. Weinstein
*Attorney, Agent, or Firm*—Gene W. Arant

[57] ABSTRACT

A prepared meat patty is made thin at its radial center and is wrapped in a metal foil wrapper so that heat for cooking the patty may be applied to its circumferential edge through the wrapper. In one form, the wrapper is vented.

4 Claims, 2 Drawing Figures

WRAPPED MEAT PATTY HAVING THINNED CENTRAL PORTION

IDENTIFICATION OF REFERENCED PATENT

The present application is a division of my copending prior application Ser. No. 654,712 filed Feb. 3, 1976, which is a continuation-in-part of Ser. No. 209,738, filed Dec. 20, 1971, now abandoned. The entire drawing and specification of the patent are incorporated herein by reference in order to provide a full and complete disclosure of the present invention.

SUMMARY OF THE INVENTION

The present invention pertains to a prepared meat product adapted to be cooked in its package. More particularly the invention pertains to a meat product comprising a meat patty having convexly formed upper and lower surfaces so that the thickness of the central portion is about half of that of the peripheral portions, and a meat foil wrapper encompassing the meat patty whereby the top and bottom walls of the wrapper substantially conform to the configuration of the meat patty.

An object of the present invention is to provide a meat product which is prepared and packaged in such a manner that it may be shipped and cooked in the same package, and the cooking thereof in a highly portable type of stove or oven will still comply with health and sanitary requirements.

A further object of the present invention is to provide a meat product enclosed in a metal foil wrapper having vent openings at the radial center thereof to permit the escape of cooking gases.

A still further object of the present invention is to provide for the shielding of the hamburger, while being cooked, from the bun halves, whereby the inner wrapper is effective to restrict the outward flow of heat energy and moisture from the hamburger into the bun halves, thereby causing the meat patty to cook more rapidly.

DRAWING SUMMARY

FIG. 1 herein, corresponding to FIG. 87 of my referenced patent, illustrates an embodiment of the invention, namely, a meat patty enclosed by a metal foil wrapper.

FIG. 2 herein, corresponding to FIG. 102 of my referenced patent, illustrates a second embodiment of the invention, namely, a meat patty enclosed by a metal foil wrapper having vent openings in the radial center thereof.

DETAILED DESCRIPTION

Figure 1:
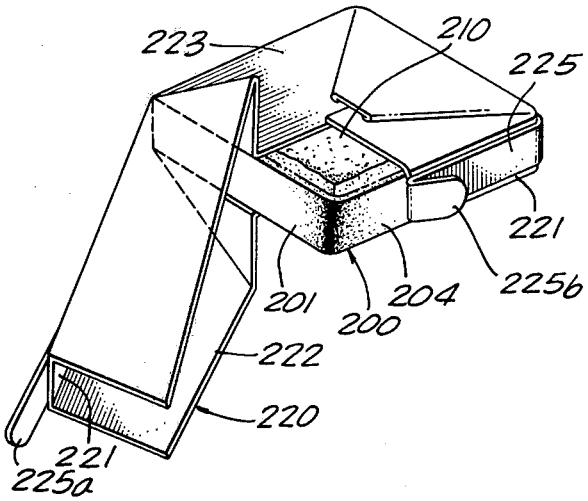
Figure 2:
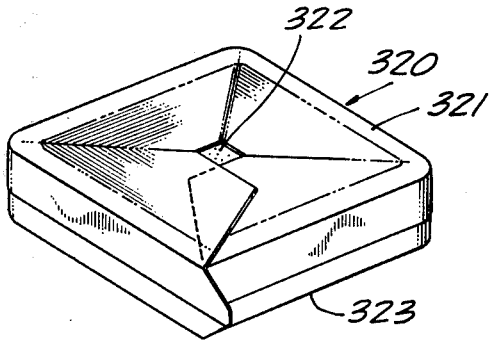

A meat patty 200 of generally flat rectangular configuration has convexly formed depressions in its upper and lower surfaces which become progressively deeper towards the center of the meat patty, such that the thickness of its central portion is about half that of its peripheral portions. A small quantity of cooking sauce 210 may, if desired, be placed in the upper surface of the meat patty. A metal foil wrapper 220 is made of such configuration as to wrap all the way around the patty and to substantially cover both its upper and lower surfaces. More specifically, however, the folded portions of the cover do not completely overlap each other with the result that small vent openings such as opening 322 shown in FIG. 2 remain in the radial center of the meat patty, in both the upper and lower wall of the wrapper.

After the wrapper has been wrapped around the meat patty, its upper and lower walls are compressed together so that they substantially conform to the configuration of the meat patty.

What I claim is:

1. In a packaged meat product adapted to be cooked in its package by the application of heat at the circumferential edge of the package, the combination comprising:

a meat patty having a shallow depression in both its upper and lower surfaces with each depression becoming progressively deeper towards the center thereof such that the thickness of the central portion of the meat patty is of the order of half the thickness of its peripheral portion; and a metal foil wrapper encompassing said meat patty on all sides, the bottom wall of said wrapper being convexly upwardly curved, and the top wall thereof being convexly downwardly curved, so as to substantially conform to the configuration of said meat patty.

2. A meat patty as in claim 1 wherein said wrapper has vent openings at the radial center of said meat patty.

3. A meat patty as in claim 1 which is of rectangular configuration.

4. A meat patty as in claim 2 which is of rectangular configuration.

* * * * *